US010184501B2

(12) United States Patent
Nomura

(10) Patent No.: US 10,184,501 B2
(45) Date of Patent: Jan. 22, 2019

(54) FLUID PRESSURE CYLINDER

(71) Applicant: SMC CORPORATION, Chiyoda-ku (JP)

(72) Inventor: Kenji Nomura, Matsudo (JP)

(73) Assignee: SMC CORPORATION, Chiyoda-ku (JP)

( * ) Notice: Subject to any disclaimer, the term of this patent is extended or adjusted under 35 U.S.C. 154(b) by 428 days.

(21) Appl. No.: 14/785,906

(22) PCT Filed: Nov. 13, 2013

(86) PCT No.: PCT/JP2013/081221
§ 371 (c)(1),
(2) Date: Oct. 21, 2015

(87) PCT Pub. No.: WO2014/181489
PCT Pub. Date: Nov. 13, 2014

(65) Prior Publication Data

US 2016/0076559 A1 Mar. 17, 2016

(30) Foreign Application Priority Data

May 7, 2013 (JP) ..... 2013-097794

(51) Int. Cl.
*F15B 15/14* (2006.01)

(52) U.S. Cl.
CPC ..... *F15B 15/1438* (2013.01); *F15B 15/149* (2013.01); *F15B 15/1433* (2013.01); *F15B 15/1442* (2013.01)

(58) Field of Classification Search
CPC ..... F15B 15/1442; F15B 15/1433; F15B 15/1438
(Continued)

(56) References Cited

U.S. PATENT DOCUMENTS 2,719,510 A * 10/1955 Elder ..... F15B 15/223 277/553
2,755,775 A 7/1956 Flick et al.
(Continued)

FOREIGN PATENT DOCUMENTS

CN 102575696 A 7/2012
DE 44 38 196 A1 10/1995
(Continued)

OTHER PUBLICATIONS

WO 2012151709 (Mueller, previously cited USPGPUB 20150159753 used as an English translation).*
(Continued)

*Primary Examiner* — Nathaniel E Wiehe
*Assistant Examiner* — Richard C Drake
(74) *Attorney, Agent, or Firm* — Oblon, McClelland, Maier & Neustadt, L.L.P.

(57) ABSTRACT

In a fluid pressure cylinder, a first positioning ring is provided detachably on a first annular projection of a head cover, and a second positioning ring is provided detachably on a second annular projection of a rod cover. Further, a structure is provided in which opposite ends of a cylinder tube are inserted over and capable of being retained on outer circumferential sides of the first and second positioning rings. As a result, by preparing a new cylinder tube having a different diameter, and new first and second positioning rings, and mounting the new cylinder tube through the new first and second positioning rings, which are installed on the first and second annular projections, a fluid pressure cylinder having a different bore diameter can be obtained.

7 Claims, 7 Drawing Sheets

(58) Field of Classification Search
USPC ..... 92/169.1; 91/418
See application file for complete search history.

(56) References Cited

U.S. PATENT DOCUMENTS

| | | | | |
|---|---|---|---|---|
| 2,853,974 | A * | 9/1958 | Hewitt | F15B 15/223 417/437 |
| 3,113,490 | A * | 12/1963 | Weaver | F15B 15/1438 92/118 |
| 3,598,021 | A * | 8/1971 | Langland | F16J 10/02 292/256.67 |
| 4,384,511 | A * | 5/1983 | Mefferd | F15B 15/1438 92/164 |
| 5,471,909 | A * | 12/1995 | Kobelt | F15B 15/1433 92/161 |
| 5,601,463 | A * | 2/1997 | Kobelt | B63H 21/265 114/150 |
| 5,737,998 | A * | 4/1998 | Wang | F15B 15/14 92/85 A |
| 5,806,406 | A * | 9/1998 | Pettersson | F15B 15/1433 92/128 |
| 8,459,618 | B2 * | 6/2013 | Suzuki | B01D 53/22 261/104 |
| 2008/0134881 | A1 | 6/2008 | Tokumoto | |
| 2012/0160093 | A1 | 6/2012 | Taniguchi et al. | |
| 2012/0312155 | A1 * | 12/2012 | Beaulieu | F15B 15/223 91/418 |
| 2015/0159753 | A1 * | 6/2015 | Mueller | F15B 15/1438 92/165 R |
| 2015/0285277 | A1 * | 10/2015 | Takakuwa | F15B 15/17 91/418 |
| 2018/0100523 | A1 * | 4/2018 | Fenn | F16H 35/18 |

FOREIGN PATENT DOCUMENTS

| | | | |
|---|---|---|---|
| DE | 198 43 253 | A1 | 3/2000 |
| DE | 102 40 093 | A1 | 4/2004 |
| DE | 20 2004 002 852 | U1 | 5/2004 |
| DE | 10 2009 014 817 | A1 | 9/2010 |
| JP | 56-146105 | U | 11/1981 |
| JP | 57-182606 | U | 11/1982 |
| JP | 2002-147410 | A | 5/2002 |
| JP | 2008-164163 | A | 7/2008 |
| WO | WO 88/03609 | A1 | 5/1988 |

OTHER PUBLICATIONS

Combined Chinese Office Action and Search Report dated Jun. 2, 2016 in Patent Application No. 201380076366.0 (with English language translation).
Office Action dated Jul. 5, 2016 in Japanese Patent Application No. 2013-097794 (with Partial English translation).
Office Action dated Oct. 17, 2017 in German Patent Application No. 11 2013 007 048.0.
International Search Report and Written Opinion dated Jul. 4, 2014 in PCT/JP2013/081221 filed Nov. 13, 2013.
Combined Taiwanese Office Action and Search Report dated Oct. 15, 2015 in Patent Application No. 102141219 (with Partial English Translation).
Japanese Office Action dated Nov. 4, 2015 in Patent Application No. 2013-097794 (with Partial English Translation).

* cited by examiner

FLUID PRESSURE CYLINDER

TECHNICAL FIELD

The present invention relates to a fluid pressure cylinder in which a piston is displaced in an axial direction under the supply of a pressure fluid.

BACKGROUND ART

Heretofore, as a transport means for a workpiece or the like, for example, a fluid pressure cylinder has been used having a piston that is displaced under the supply of a pressure fluid.

Such a fluid pressure cylinder, for example, as disclosed in Japanese Laid-Open Utility Model Publication No. 56-146105, includes a cylindrically shaped cylinder tube, a cylinder cover disposed on an end of the cylinder tube, and a piston provided displaceably in the interior of the cylinder tube. In addition, by supplying a pressure fluid to a port of the cylinder cover, the piston is pressed and displaced in an axial direction by the pressure fluid, which is introduced to the interior of the cylinder tube. A thrust force applied in the axial direction of the piston is converted into an output of the fluid pressure cylinder.

The fluid pressure cylinder includes a spigot joint, which projects toward the side of the cylinder tube, provided on an end of the cylinder cover. The cylinder tube is inserted over an outer circumferential side of the spigot joint, whereby the cylinder tube and the cylinder cover are assembled in a state of being positioned in both axial and radial directions.

SUMMARY OF INVENTION

With the above fluid pressure cylinder, for example, when changes are made to the shape or weight, etc., of a transported workpiece, since the size of the required output of the fluid pressure cylinder also is subject to change, it is necessary to prepare a different type of fluid pressure cylinder with a different output size corresponding to the change in the workpiece, which leads to an increase in equipment costs.

Further, in recent years, from the standpoints of energy conservation and cost reduction, it is desired to use a fluid pressure cylinder that can obtain an ideal output commensurate with the shape and weight, etc., of the workpiece. However, in general, it is difficult to finely set specifications of different bore diameters (cylinder diameters) in a fluid pressure cylinder, and out of necessity, a fluid pressure cylinder, in some cases, must be used, which is equipped with an output capability larger than a desired output. In such cases, the output used to transport the workpiece is excessive, and a surplus amount of pressure fluid ends up being used, and thus the amount of pressure fluid consumed increases beyond the originally intended consumption amount, which runs contrary to trends to reduce energy consumption prevalent in recent years.

A general object of the present invention is to provide a fluid pressure cylinder, which is capable of suppressing equipment costs while enabling the output of the cylinder to be freely changed, together with reducing energy consumption, by easily carrying out a change in the cylinder diameter of the fluid pressure cylinder.

The present invention is characterized by a fluid pressure cylinder comprising a cylindrically shaped cylinder tube having a cylinder chamber in the interior thereof, a pair of cover members mounted on both ends of the cylinder tube, and a piston disposed displaceably along the cylinder chamber, wherein positioning means for retaining the cylinder tube radially and coaxially with respect to the cover members are disposed detachably between the cylinder tube and the cover members.

According to the present invention, in a fluid pressure cylinder in which the pair of cover members are mounted respectively on both ends of the cylindrically shaped cylinder tube having a cylinder chamber in the interior thereof, and in which the piston is disposed displaceably along the cylinder tube, the positioning means are disposed detachably between the cover members and the cylinder tube, and as a result of the positioning means, the cylinder tube is capable of being held radially and coaxially with respect to the cover members.

Accordingly, when a cylinder tube is replaced with a different cylinder tube having a cylinder chamber of a different diameter, the positioning means are removed from the cover members, and other positioning means that correspond in size to the different cylinder tube are installed, whereby the cylinder tube can easily be exchanged and replaced by the different cylinder tube having the different diameter while the same cover members are used.

As a result, in the event that the output obtained by the fluid pressure cylinder is to be changed, it becomes possible to change the output using the same cover members of the fluid pressure cylinder, and to obtain a desired output, without any need to prepare a different fluid pressure cylinder equipped with a cylinder tube having a different diameter and a piston having a different diameter and disposed in the interior of the cylinder tube. More specifically, since equipment costs for preparing a new fluid pressure cylinder can be suppressed, together with enabling a fluid pressure cylinder to be constructed in which a cylinder tube can be selected having an optimum diameter (bore diameter) for obtaining a desired output, for example, compared to the case of using a fluid pressure cylinder having an excessive output capability in relation to the desired output, the fluid pressure cylinder can be operated with minimum consumption of pressure fluid, and energy savings can be realized.

The above and other objects, features and advantages of the present invention will become more apparent from the following description when taken in conjunction with the accompanying drawings in which a preferred embodiment of the present invention is shown by way of illustrative example.

DESCRIPTION OF EMBODIMENTS

Figure 1:
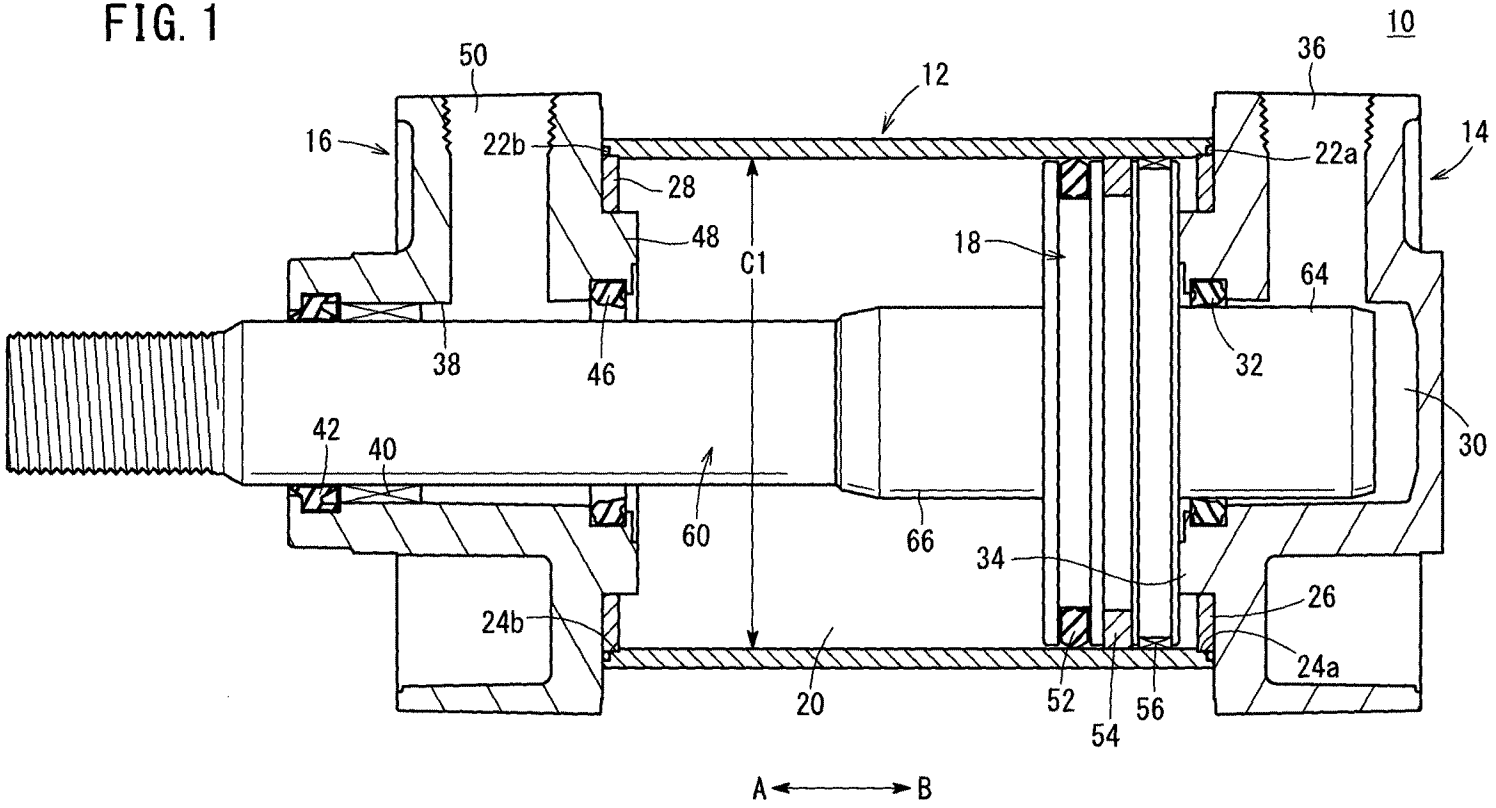
FIG. 1 is an overall cross sectional view of a fluid pressure cylinder according to a first embodiment of the present invention.
Figure 2:
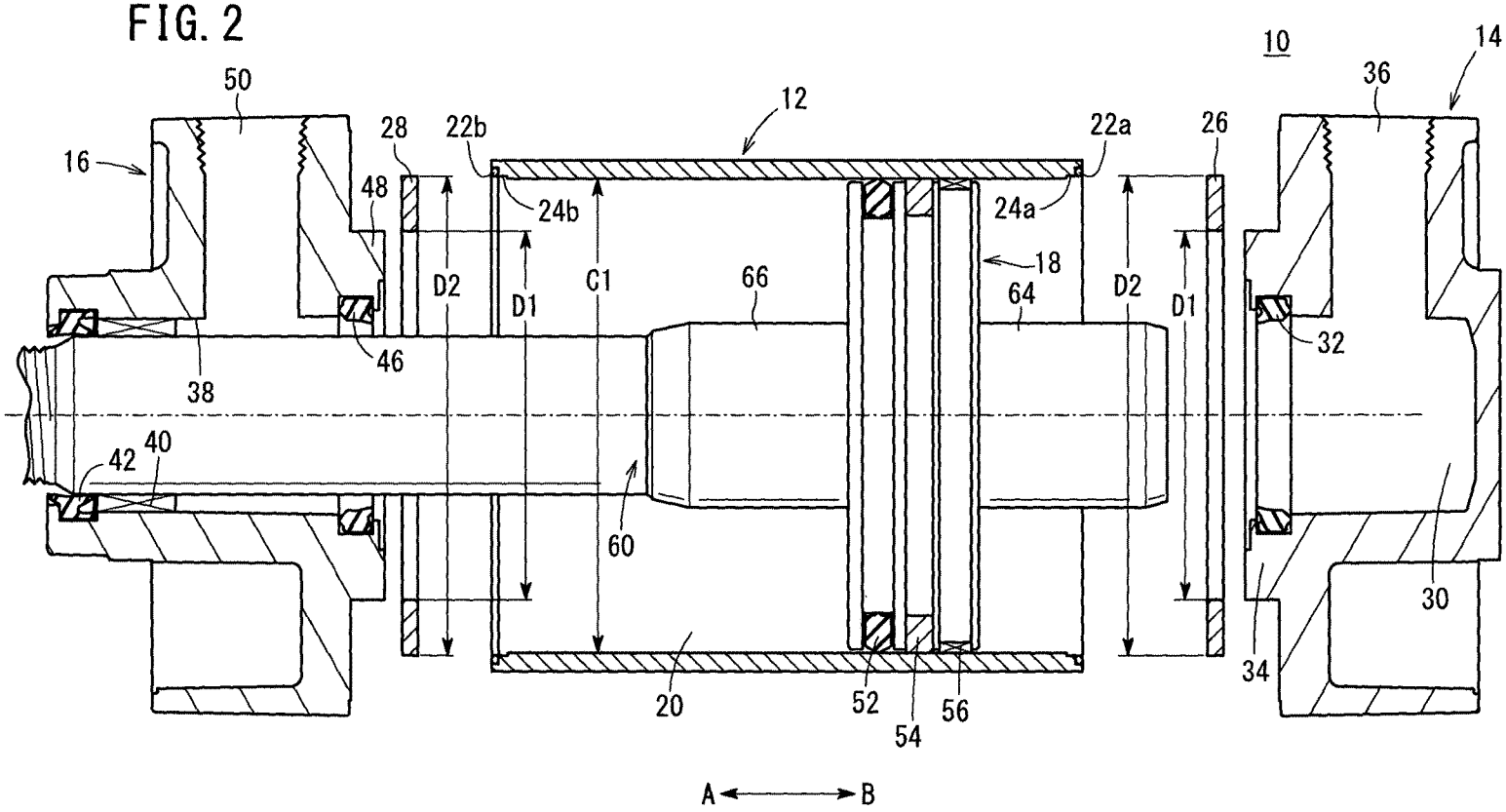
FIG. 2 is an exploded cross sectional view of the fluid pressure cylinder of FIG. 1.

As shown in FIGS. 1 and 2, a fluid pressure cylinder 10 includes a cylindrically shaped cylinder tube 12, a head cover (cover member) 14 mounted on one end of the cylinder tube 12, a rod cover (cover member) 16 mounted on another end side of the cylinder tube 12, and a piston 18, which is disposed displaceably in the interior of the cylinder tube 12.

The cylinder tube 12 is made up from a cylindrical body that extends with a substantially constant diameter (cylinder diameter C1) along an axial direction (the direction of arrows A and B). In the interior of the cylinder tube 12, a cylinder chamber 20 in which the piston 18 is accommodated is formed.

Further, on both ends in the axial direction (the direction of arrows A and B) of the cylinder tube 12, o-rings (seal members) 22*a*, 22*b* are disposed respectively via annular grooves. Together therewith, annular engagement grooves (grooves) 24*a*, 24*b*, which are recessed in a radial outward direction, are formed respectively on inner circumferential surfaces of both ends of the cylinder tube 12. First and second positioning rings (positioning members) 26, 28, to be described later, are engaged in the engagement grooves 24*a*, 24*b*.

The head cover 14, for example, is formed from a metal material with a substantially rectangular shape in cross section, and includes penetrating holes that penetrate in the axial direction (indicated by the arrows A and B) through four corners of the head cover 14. Non-illustrated connecting rods are inserted through the penetrating holes.

In a center portion of the head cover 14, a cavity 30 of a predetermined depth is formed in facing relation to the side of the cylinder tube 12 (in the direction of the arrow A), and a first seal ring 32 is installed in an annular groove formed on an inner circumferential surface of the cavity 30. The cavity 30 is substantially circular in cross section with a substantially constant diameter, and communicates with the cylinder chamber 20 when the head cover 14 is installed on the one end of the cylinder tube 12.

Further, a first annular projection 34, which projects toward the side of the cylinder tube 12 (in the direction of the arrow A), is formed on one end surface of the head cover 14 on the side of the cylinder tube 12 (in the direction of the arrow A). The first annular projection 34 is formed coaxially with the cavity 30 and in an annular shape on an outer circumferential side of the cavity 30.

An annular first positioning ring 26 is mounted on an outer circumferential side of the first annular projection 34, and the cylinder tube 12 is retained by engagement of an outer circumferential surface of the first positioning ring 26 with the engagement groove 24*a*, which is formed on the one end of the cylinder tube 12. More specifically, as shown in FIGS. 1 and 2, the first positioning ring 26 is formed such that an inner diameter D1 thereof (see FIG. 2) has substantially the same diameter as the outer diameter of the first annular projection 34, and an outer diameter D2 thereof (see FIG. 2) has substantially the same diameter as the inner diameter of the engagement groove 24*a* in the cylinder tube 12.

On the other hand, on the side surface of the head cover 14, a first fluid port 36 is provided through which the pressure fluid is supplied and discharged, the first fluid port 36 communicating with the cavity 30. In addition, the pressure fluid is introduced into the cavity 30 after the pressure fluid has been supplied to the first fluid port 36 from a non-illustrated pressure fluid supply source.

The rod cover 16, for example, is formed from a metal material with a substantially rectangular shape in cross section, and includes penetrating holes that penetrate in the axial direction through four corners of the rod cover 16. The connecting rods are inserted through the penetrating holes. In addition, as shown in FIG. 1, in a condition in which the cylinder tube 12 is mounted between the rod cover 16 and the head cover 14, by screw-engagement of nuts onto both ends of the connecting rods that are inserted through the head cover 14 and the rod cover 16, the cylinder tube 12 is sandwiched and fixed between the head cover 14 and the rod cover 16.

Further, a center portion of the rod cover 16 bulges in a direction away from the cylinder tube 12. In a substantially center portion of the bulge, a rod hole 38 is formed and penetrates in the axial direction (the direction of arrows A and B). In addition, a bush 40 and a rod packing 42 are installed on an inner circumferential surface of the rod hole 38. A second seal ring 46 is installed via an annular groove provided in the inner circumferential surface of the rod hole 38. The rod hole 38 communicates with the cylinder chamber 20.

Furthermore, a second annular projection 48, which projects toward the side of the cylinder tube 12 (in the direction of the arrow B) is formed on one end surface of the rod cover 16 on the side of the cylinder tube 12 (in the direction of the arrow B). The second annular projection 48 is formed in an annular shape on an outer circumferential side of the rod hole 38 coaxially with the rod hole 38. Further, the second annular projection 48 is coaxial with the first annular projection 34 of the head cover 14, and has the same diameter as the first annular projection 34 of the head cover 14.

Figure 3:
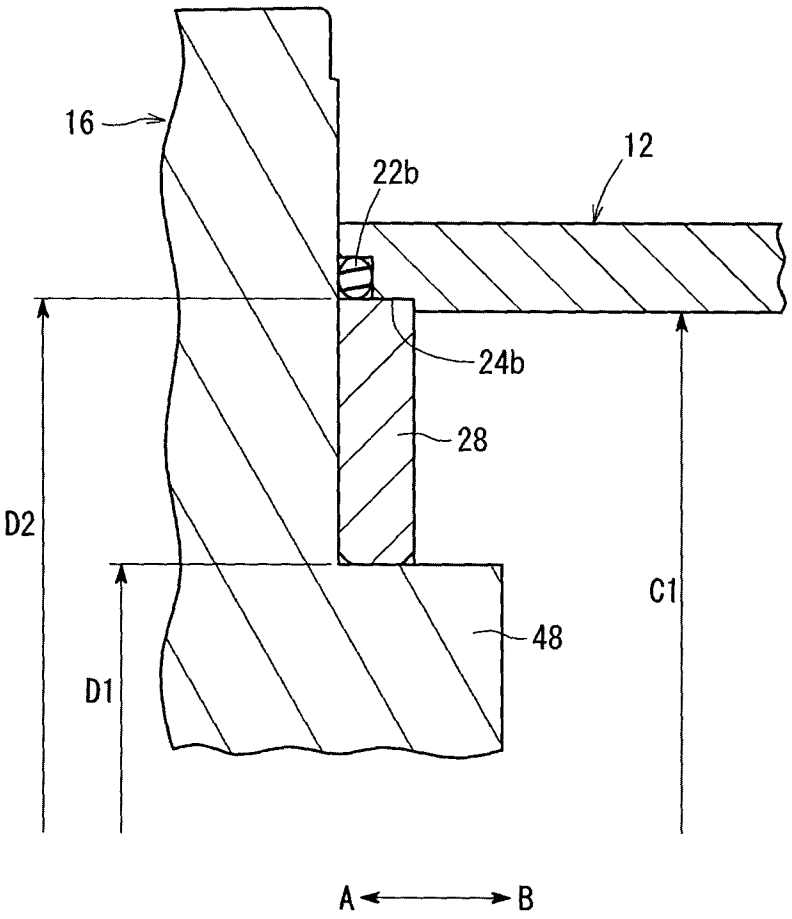
FIG. 3 is an enlarged cross sectional view showing the vicinity of a second positioning ring on a rod cover shown in FIG. 1.

Further, as shown in FIG. 3, an annular second positioning ring 28 is installed on the outer circumferential surface of the second annular projection 48. The outer circumferential surface of the second positioning ring 28 engages with the engagement groove 24*b* that is formed on the other end of the cylinder tube 12, thereby retaining the cylinder tube 12. More specifically, as shown in FIG. 2, the second positioning ring 28 is formed such that an inner diameter D1 thereof has substantially the same diameter as the outer diameter of the second annular projection 48, and an outer diameter D2 thereof has substantially the same diameter as the inner diameter of the engagement groove 24*b* in the cylinder tube 12.

Moreover, the second positioning ring 28 is formed in the same shape as the first positioning ring 26. Stated otherwise, the first and second positioning rings 26, 28 are provided as a pair.

On the other hand, a second fluid port 50 through which the pressure fluid is supplied and discharged is disposed on a side surface of the rod cover 16, and the second fluid port 50 communicates with the rod hole 38. In addition, the pressure fluid supplied from the second fluid port 50 is introduced to the cylinder chamber 20 from the rod hole 38.

As shown in FIGS. 1 and 2, the piston 18 is formed with substantially the same diameter as the cylinder diameter C1 of the cylinder tube 12. A piston packing 52, a magnetic body 54, and a wear ring 56 are installed via a plurality of annular grooves on the outer circumferential surface of the piston 18.

Further, a piston hole (not shown) that penetrates in the axial direction (the direction of arrows A and B) is formed in a center portion of the piston 18. One end of a piston rod 60 is inserted and connected in the piston hole.

One end of the piston rod 60 is connected to the piston 18, whereas the other end of the piston rod 60 is inserted through the rod hole 38 and is supported displaceably by the bush 40.

Further, first and second cushion rings 64, 66 are mounted respectively on both end surfaces of the piston 18. The first and second cushion rings 64, 66 are formed in substantially the same shape. The first cushion ring 64 is arranged on one end side of the piston 18 on the side of the head cover 14 (in the direction of the arrow B), and projects outwardly from the one end side. On the other hand, the second cushion ring 66 is arranged on the other end side of the piston 18 on the side of the rod cover 16 (in the direction of the arrow A), and is disposed in covering relation to the outer circumferential surface of the piston rod 60.

In addition, the first and second cushion rings 64, 66 are inserted respectively into the cavity 30 and the rod hole 38 upon displacement of the piston 18 in the axial direction, and by sliding contact of the cushion rings 64, 66 with the first and second seal rings 32, 46, the displacement velocity of the piston 18 is reduced.

The fluid pressure cylinder 10 according to the first embodiment of the present invention is constructed basically as described above. Next, operations and advantageous effects of the fluid pressure cylinder will be described. The condition shown in FIG. 1, in which the piston 18 is displaced toward the side of the head cover 14 (in the direction of the arrow B), and the first cushion ring 64 is accommodated in the cavity 30, will be referred to as an initial condition.

Initially, a pressure fluid from a non-illustrated pressure fluid supply source is introduced to the first fluid port 36. In this case, the second fluid port 50 is placed in a state of being open to atmosphere under a switching action of a non-illustrated switching valve. Consequently, the pressure fluid is supplied into the cavity 30 from the first fluid port 36, and by means of the pressure fluid, which is introduced into the cylinder chamber 20 from the cavity 30, the piston 18 is pressed toward the side of the rod cover 16 (in the direction of the arrow A). In addition, the piston rod 60 also is displaced due to displacement of the piston 18, and the first cushion ring 64 mounted on the end of the piston rod 60 separates away from the cavity 30 while in sliding contact with the first seal ring 32.

Next, upon further displacement of the piston 18, the second cushion ring 66 is inserted into the rod hole 38, whereby the flow rate of the pressure fluid is restricted and is compressed at the interior of the cylinder chamber 20. As a result, displacement resistance is created when the piston 18 is displaced, and the displacement velocity of the piston 18 decreases gradually as the piston 18 approaches the displacement end position thereof.

Lastly, the piston 18 gradually is displaced toward the side of the rod cover 16 (in the direction of the arrow A), whereupon the second cushion ring 66 becomes accommodated completely in the rod hole 38, whereby the displacement end position is reached in which the piston 18 has reached the side of the rod cover 16 (in the direction of the arrow A).

On the other hand, in the case that the piston 18 is displaced in the opposite direction (in the direction of the arrow B), pressure fluid is supplied to the second fluid port 50, and the first fluid port 36 is placed in a state of being open to atmosphere under a switching action of a non-illustrated switching valve. In addition, the pressure fluid is supplied into the rod hole 38 from the second fluid port 50, and by means of the pressure fluid, which is introduced into the cylinder chamber 20 from the rod hole 38, the piston 18 is pressed toward the side of the head cover 14 (in the direction of the arrow B).

In addition, the piston rod 60 also is displaced due to displacement of the piston 18, and the second cushion ring 66 mounted on the end of the piston rod 60 separates away from the rod hole 38 while in sliding contact with the second seal ring 46.

Next, upon further displacement of the piston 18, the first cushion ring 64 is inserted into the cavity 30, whereby the flow rate of the pressure fluid is restricted and is compressed at the interior of the cylinder chamber 20. As a result, displacement resistance is created when the piston 18 is displaced, and the displacement velocity of the piston 18 decreases gradually. Additionally, by abutment of the piston 18 against the head cover 14, the initial position is restored (see FIG. 1).

Next, a situation will be explained in which, in order to change the output of the aforementioned fluid pressure cylinder 10, the cylinder tube 12 and the piston 18 are exchanged and replaced with a different cylinder tube 12 and piston 18, to thereby change the bore diameter (cylinder diameter). Incidentally, in the situation, by reducing the bore diameter, the output is decreased.

At first, non-illustrated nuts, which are screw-engaged with the connecting rods, are loosened, thereby releasing the state of connection of the head cover 14 and the rod cover 16 with the cylinder tube 12 therebetween. Thereafter, as shown in FIG. 2, the head cover 14 and the rod cover 16 are separated mutually in axial directions (the directions of arrows A and B) away from the cylinder tube 12, followed by the first positioning ring 26 being removed from the first annular projection 34, and the second positioning ring 28 being removed from the second annular projection 48.

Figure 4:
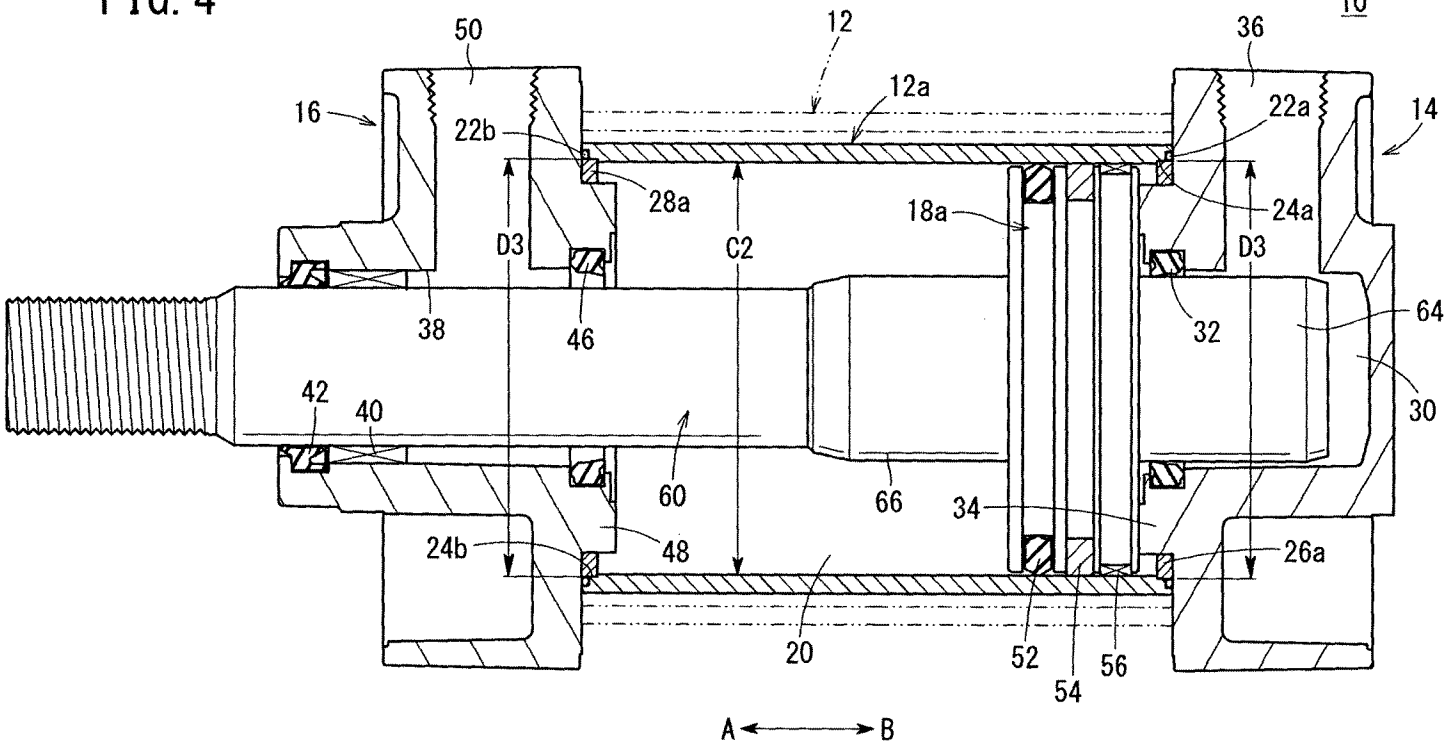
FIG. 4 is an overall cross sectional view showing a condition in which a new cylinder tube having a different diameter is exchanged in the fluid pressure cylinder of FIG. 1.

Next, as shown in FIG. 4, a new cylinder tube 12*a* having a smaller cylinder diameter C2 than that of the aforementioned cylinder tube 12, new first and second positioning rings 26*a*, 28*a* having outer diameters D3 that are substantially the same as the cylinder diameter C2, and a new piston 18*a* formed with substantially the same diameter as the cylinder diameter C2 are prepared.

Moreover, the new first and second positioning rings 26*a*, 28*a* are formed with inner diameters, which are substantially the same as the diameters (D1) of the aforementioned first and second positioning rings 26, 28.

In this case, the length in the axial direction of the new cylinder tube 12*a* is the same as the length of the cylinder tube 12.

The first positioning ring 26*a* is mounted on the first annular projection 34 of the head cover 14, and the second positioning ring 28*a* is mounted on the second annular projection 48 of the rod cover 16, whereby the first and second positioning rings 26*a*, 28*a* are retained respectively with respect to the head cover 14 and the rod cover 16.

At this time, the outer diameters D3 of the first and second positioning rings 26*a*, 28*a* are smaller than the outer diameters D2 of the aforementioned first and second positioning rings 26, 28 (D3<D2).

Lastly, one end of the cylinder tube 12*a* is inserted over the outer circumference of the first positioning ring 26*a*, and the first positioning ring 26*a* is placed in engagement with the engagement groove 24*a* formed on the inner circumferential surface of the one end of the cylinder tube 12*a*, whereby the one end of the cylinder tube 12*a* is retained with respect to the head cover 14. In addition, in a condition in which the piston 18*a*, which has a small diameter corresponding to the inner diameter of the cylinder tube 12*a*, has been inserted into the interior of the cylinder tube 12*a*, the other end of the cylinder tube 12*a* is inserted over the outer circumference of the second positioning ring 28*a*.

By engagement of the second positioning ring 28*a* with the engagement groove 24*b* formed in the other end of the cylinder tube 12*a*, a state is brought about in which the rod cover 16 is installed on the other end of the cylinder tube 12*a*. In this condition, connecting rods (not shown) are inserted through the head cover 14 and the rod cover 16, and by screw-engagement and fastening of nuts on opposite ends of the connecting rods, the head cover 14 and the rod cover 16 are connected while sandwiching and gripping the cylinder tube 12*a* therebetween.

Consequently, in the fluid pressure cylinder 10, the cylinder tube 12 and the piston 18 thereof are replaced by a cylinder tube 12*a* and a piston 18*a* having a smaller cylinder diameter C2, and under a displacement action of the piston 18*a*, the output force, which is output in the axial direction from the piston rod 60, is made smaller. In this manner, for example, in the case that the output corresponding to the weight, etc., of the transported workpiece is small, by exchanging to a small cylinder tube 12*a* having a smaller cylinder diameter, together with first and second positioning rings 26*a*, 28*a* and a piston 18*a* of small diameters corresponding to the diameter of the cylinder tube 12*a*, since an optimal output corresponding to the workpiece is obtained, the consumption amount of pressure fluid used in the fluid pressure cylinder 10 can be reduced, and energy savings can be realized.

On the other hand, in the case that the bore diameter in the fluid pressure cylinder 10 is to be made larger, a cylinder tube 12 having a larger cylinder diameter, a piston 18 having a diameter corresponding to the cylinder diameter, and first and second positioning rings 26, 28 corresponding to the inner diameter of the cylinder tube 12 are prepared and assembled, whereby the output of the fluid pressure cylinder 10 can easily be increased.

Stated otherwise, in the fluid pressure cylinder 10, by changing cylinder tubes 12 equipped with various different diameters, as well as changing the first and second positioning rings 26, 28 and the piston 18 corresponding to the inner diameters of such cylinder tubes 12, the output of the fluid pressure cylinder 10 can easily be changed, while the same head cover 14 and rod cover 16 are used.

More specifically, the first and second positioning rings 26, 28 function as positioning means for retaining both ends of the cylinder tube 12 radially and coaxially with respect to the head cover 14 and the rod cover 16.

In the foregoing manner, with the first embodiment, the first and second positioning rings 26, 28, which function as positioning means, are disposed detachably on the first annular projection 34 of the head cover 14 and the second annular projection 48 of the rod cover 16 that constitute the fluid pressure cylinder 10, and a structure is provided, which is capable of positioning and retaining both ends of the cylinder tube 12 by the outer circumferential surfaces of the first and second positioning rings 26, 28. Owing thereto, by exchanging a new cylinder tube 12*a* having a different cylinder diameter, new first and second positioning rings 26*a*, 28*a* corresponding to the inner diameter of the cylinder tube 12*a*, and a new piston 18*a* having a diameter corresponding thereto, using the same head cover 14 and the same rod cover 16, a fluid pressure cylinder 10 having a different bore diameter (cylinder diameter) can easily be constructed.

As a result, in the case that the output obtained by the fluid pressure cylinder 10 is to be changed, it is possible to change the output using the same head cover 14 and rod cover 16 of the fluid pressure cylinder 10, and to obtain a desired output, without any need to prepare another fluid pressure cylinder equipped with a piston 18 having a different diameter and a cylinder tube 12 having a different diameter.

More specifically, equipment costs for preparing a new fluid pressure cylinder can be suppressed, together with enabling a fluid pressure cylinder 10 to be constructed in which a cylinder tube and a piston can be selected to have an optimum diameter (bore diameter) for obtaining a desired output. Owing thereto, for example, compared to the case of using a fluid pressure cylinder having an excessive output capability in relation to the desired output, the fluid pressure cylinder 10 can be operated with minimum consumption of pressure fluid, and energy savings can be realized.

Further, even in the case that the cylinder tube 12, the piston 18, and the first and second positioning rings 26, 28 are exchanged, and the cylinder diameter (C1, C2) of the cylinder chamber 20 in the fluid pressure cylinder 10 is changed, by maintaining the length dimension of the new cylinder tube 12*a* at the same length, there is no need to alter the length dimension of the fluid pressure cylinder 10.

Owing thereto, for example, in the case that the fluid pressure cylinder 10 is used on an assembly line, and is attached to the assembly line via the head cover 14 and the rod cover 16, the fluid pressure cylinder can be mounted reliably at the prior attachment position without changes to the attachment position (attachment pitch) thereof. As a result, it is possible to easily change the bore diameter of a fluid pressure cylinder 10 used on an assembly line, and to easily and reliably install the fluid pressure cylinder 10 with respect to the assembly line.

Furthermore, by providing the o-rings 22*a*, 22*b* on both ends of the cylinder tube 12, which are capable of being placed in abutment with ends of the head cover 14 and the rod cover 16, even in the case that a different cylinder tube 12*a* that differs in cylinder diameter is exchanged, sealing between the cylinder tube 12*a*, the head cover 14, and the rod cover 16 can reliably be performed by the o-rings 22*a*, 22*b*.

Figure 5:
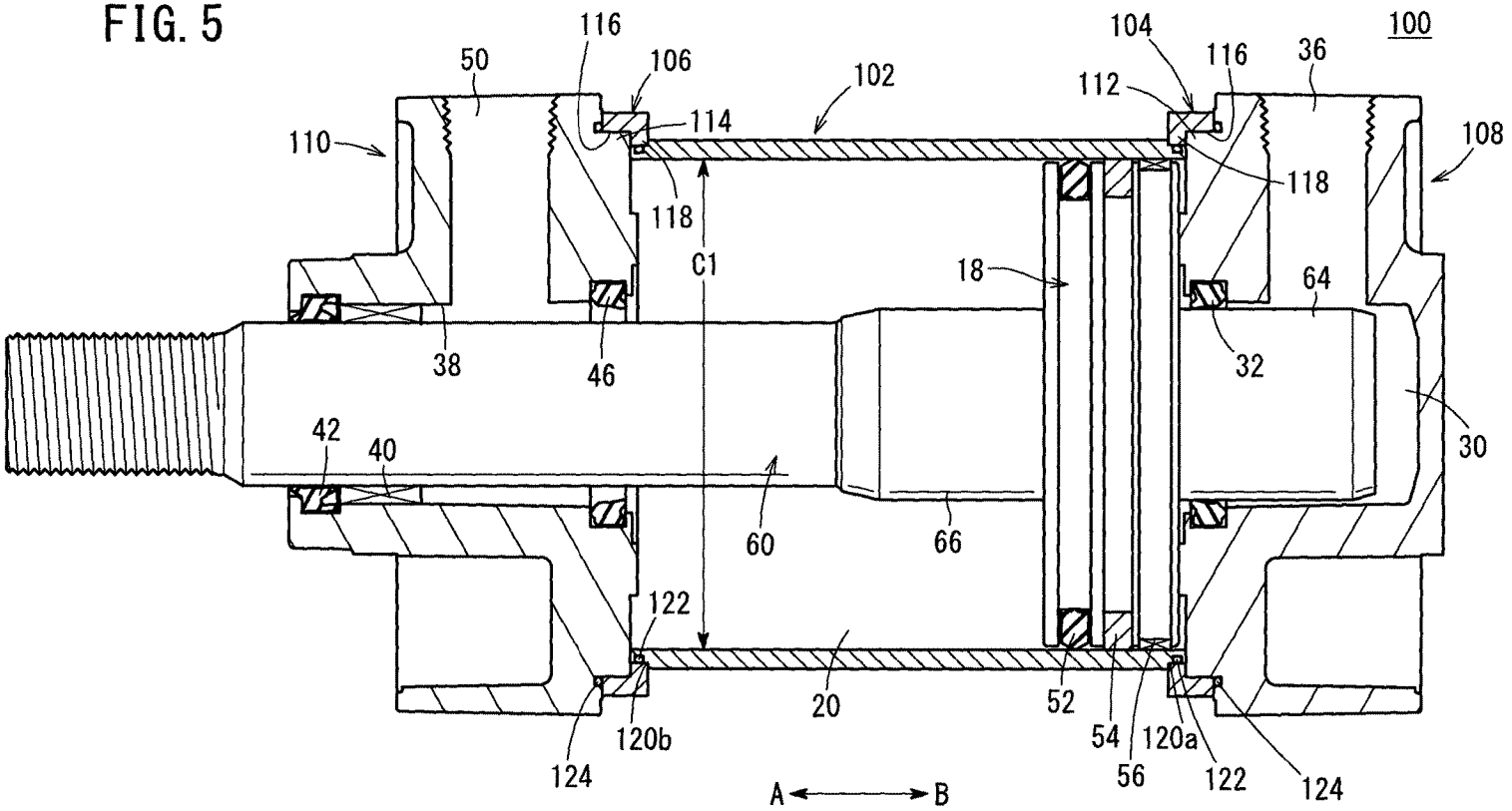
FIG. 5 is an overall cross sectional view of a fluid pressure cylinder according to a second embodiment of the present invention.
Figure 6:
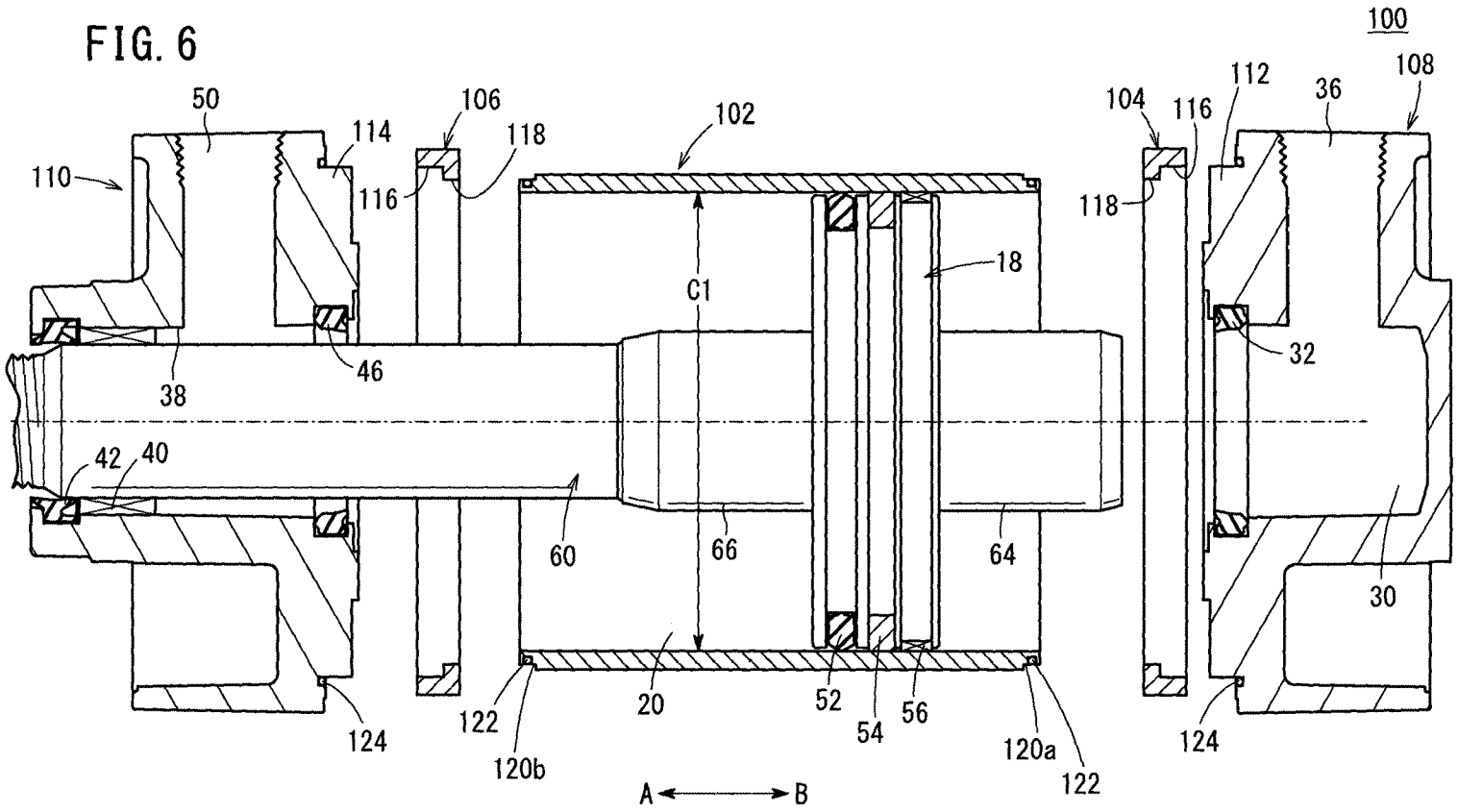
FIG. 6 is an exploded cross sectional view of the fluid pressure cylinder of FIG. 5.
Figure 7:
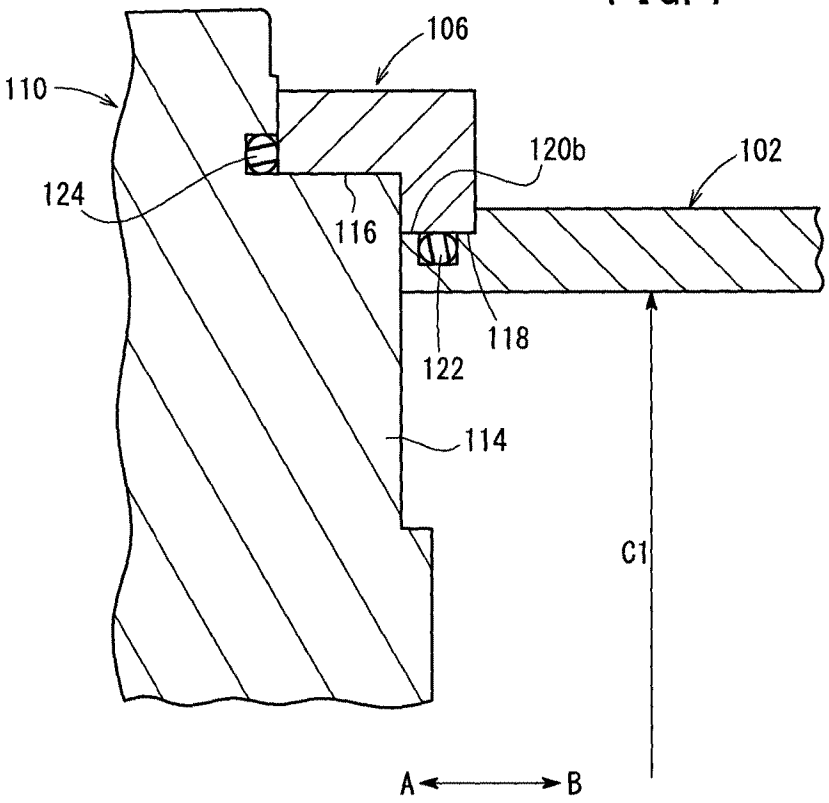
FIG. 7 is an enlarged cross sectional view showing the vicinity of a second positioning ring on a rod cover shown in FIG. 5.

Next, a fluid pressure cylinder 100 according to a second embodiment is shown in FIGS. 5 through 7. Constituent elements of the fluid pressure cylinder 100, which are the same as those of the fluid pressure cylinder 10 according to the first embodiment, are denoted by the same reference characters, and detailed description of such features is omitted.

The fluid pressure cylinder 100 according to the second embodiment differs from the fluid pressure cylinder 10 according to the first embodiment, in that first and second positioning rings (positioning members) 104, 106 are provided on outer circumferential sides on both ends of a cylinder tube 102, and the cylinder tube 102 is connected to the head cover (cover member) 108 and the rod cover (cover member) 110 through the first and second positioning rings 104, 106.

As shown in FIGS. 5 through 7, in the fluid pressure cylinder 100, a first spigot joint 112 is formed on an end surface of the head cover 108, and a second spigot joint 114 is formed on an end surface of the rod cover 110. In addition, a first positioning ring 104 is mounted on the first spigot joint 112, and one end of the cylinder tube 102 is retained thereon. A second positioning ring 106 is mounted on the second spigot joint 114, and the other end of the cylinder tube 102 is retained thereon.

The first and second positioning rings 104, 106 are formed in the same shape and include outer circumferential surfaces that are substantially constant in diameter. The first and second positioning rings 104, 106 are formed with spigot surfaces 116 on inner circumferential surfaces of ends of the first and second positioning rings 104, 106, the spigot surfaces 116 being fitted on outer circumferential surfaces of the first and second spigot joints 112, 114. On the other hand, retaining surfaces 118, which are adjacent to the spigot surfaces 116 and project in a radial inward direction with respect to the spigot surfaces 116, are formed on inner circumferential surfaces of other ends of the first and second positioning rings 104, 106. More specifically, the inner circumferential surfaces of the first and second positioning rings 104, 106 are formed in stepped shapes, such that mutual retaining surfaces 118 thereof are arranged in confronting relation.

Annular engagement grooves (grooves) 120*a*, 120*b*, which are recessed in a radial inward direction, are formed on the outer circumferential surfaces on both ends of the cylinder tube 102. The retaining surfaces 118 of the first and second positioning rings 104, 106 are engaged in the engagement grooves 120*a*, 120*b*. As a result, the first and second positioning rings 104, 106 are positioned in the axial direction (the direction of the arrows A and B) respectively with respect to both ends of the cylinder tube 102.

Further, first seal members 122 that face toward the outer circumferential side are installed in the engagement grooves 120*a*, 120*b*, such that by abutment of the first seal members 122 against inner circumferential surfaces of the first and second positioning rings 104, 106, leakage of pressure fluid that passes between the cylinder tube 102 and the first and second positioning rings 104, 106 is prevented.

Second seal members 124 are disposed, via annular grooves, on end surfaces of the head cover 108 and the rod cover 110, at locations in abutment with ends of the first and second positioning rings 104, 106. By abutment of the ends of the first and second positioning rings 104, 106 against the second seal members 124, leakage of pressure fluid that passes between the first positioning ring 104 and the head cover 108, and between the second positioning ring 106 and the rod cover 110 is prevented.

Next, in the case that the output of the aforementioned fluid pressure cylinder 100 is to be changed, the state of connection of the head cover 108, the cylinder tube 102, and the rod cover 110 by the connecting rods is released, and after the head cover 108 and the rod cover 110 have been separated, respectively, in axial directions away from the cylinder tube 102, the first and second positioning rings 104, 106 are detached from the first and second spigot joints 112, 114.

In addition, a new cylinder tube 102 having a different cylinder diameter, and new first and second positioning rings 104, 106 having different diameters corresponding to the cylinder tube 102 are prepared, and after the first and second positioning rings 104, 106 have been installed, respectively, on the first spigot joint 112 of the head cover 108 and the second spigot joint 114 of the rod cover 110, both ends of the cylinder tube 102 are inserted respectively on inner circumferential sides of the retaining surface 118 of the first positioning ring 104 and the retaining surface 118 of the second positioning ring 106.

Lastly, the head cover 108 and the rod cover 110 are made to approach one another mutually such that both ends of the cylinder tube 102 are inserted into the first and second positioning rings 104, 106, whereby the retaining surfaces 118 of the first and second positioning rings 104, 106 come into engagement respectively with the engagement grooves 120*a*, 120*b*. Thereafter, the connecting rods are inserted through the head cover 108 and the rod cover 110, and by screw-engagement and fastening of nuts on both ends of the connecting rods, the head cover 108 and the rod cover 110 are connected while sandwiching and gripping the cylinder tube 102 therebetween.

As a result, a fluid pressure cylinder 100 having a different bore diameter (cylinder diameter) is constructed in a condition in which both ends of the cylinder tube 102 are retained on the inner circumferential surfaces of the first and second positioning rings 104, 106.

More specifically, the first and second positioning rings 104, 106 function as positioning means for retaining both ends of the cylinder tube 102 radially and coaxially with respect to the head cover 108 and the rod cover 110.

In the foregoing manner, according to the second embodiment, the annular first and second positioning rings 104, 106 are mounted detachably on the first spigot joint 112 of the head cover 108 and the second spigot joint 114 of the rod cover 110 that make up the fluid pressure cylinder 100, and both ends of the cylinder tube 102 are inserted into the first and second positioning rings 104, 106, whereby the cylinder tube 102 can be positioned and retained in the axial direction.

Owing thereto, by replacing a cylinder tube, positioning rings, and a piston with a new cylinder tube 102 having a different cylinder diameter, new first and second positioning rings 104, 106 corresponding to the new cylinder diameter, and a new piston 18 having a diameter corresponding to the new cylinder diameter, using the same head cover 108 and the same rod cover 110, a fluid pressure cylinder 100 having a different bore diameter (cylinder diameter) can easily be constructed.

As a result, in the case that the output obtained by the fluid pressure cylinder 100 is to be changed, it is possible to change the output using the same head cover 108 and rod cover 110 of the fluid pressure cylinder 100, and to obtain a desired output, without any need to prepare another fluid pressure cylinder equipped with a piston 18 having a different diameter and a cylinder tube 102 having a different diameter.

More specifically, equipment costs for preparing a new fluid pressure cylinder can be suppressed, together with enabling a fluid pressure cylinder 100 to be constructed in which the cylinder tube 102 and the piston 18 can be selected to have an optimum diameter for obtaining a desired output. Owing thereto, for example, compared to the case of using a fluid pressure cylinder having an excessive output capability in relation to the desired output, the fluid pressure cylinder 100 can be operated with minimum consumption of pressure fluid, and energy savings can be realized.

Further, in relation to the fluid pressure cylinders 10, 100 according to the aforementioned first and second embodiments, a structure has been described in which the cylinder tube 12, 102 is sandwiched between the head cover 14, 108 and the rod cover 16, 110, and is fixed by connecting rods. However, the invention is not limited to such a structure. For example, a structure may also be provided in which the head cover and the rod cover are connected by screw-engagement with respect to both ends of the cylinder tube. More specifically, the structures of the fluid pressure cylinders are not particularly limited, so long as a structure is provided in which the cylinder tube, the head cover, and the rod cover, as separate elements, can be connected together mutually and coaxially by means of spigot joints.

The fluid pressure cylinder according to the present invention is not limited to the above embodiments. Various changes and modifications may be made to the embodiments without departing from the scope of the invention as set forth in the appended claims.

The invention claimed is:

1. A fluid pressure cylinder comprising:

a cylindrically shaped cylinder tube including a cylinder chamber in an interior thereof;

a pair of cover members mounted on both ends of the cylinder tube, each of the pair of cover members including an annular protrusion that projects into the cylinder chamber;

a piston disposed displaceably along the cylinder chamber;

positioning mechanisms for retaining the cylinder tube radially and coaxially with respect to the cover members disposed detachably between the cylinder tube and the cover members; and a seal that seals between the cylinder tube and the cover members and provided separately from the positioning mechanism, wherein the positioning mechanisms comprise positioning members disposed on inner circumferential sides on the both ends of the cylinder tube, and inner circumferential surfaces of the positioning members are on outer circumferential sides of the respective annular protrusions; and grooves which are recessed radially and through which outer circumferential surfaces of the positioning members engage with the cylinder tube, the grooves being formed on the both ends of the cylinder tube.

2. The fluid pressure cylinder according to claim 1, wherein respective seal members are disposed on the both ends of the cylinder tube, the seal members abutting against the cover members.

3. The fluid pressure cylinder according to claim 1, wherein the positioning members are mounted on the cover members.

4. The fluid pressure cylinder according to claim 1, wherein the positioning members are formed into an annular shape.

5. The fluid pressure cylinder according to claim 3, wherein the positioning members are mounted on spigot joints provided respectively on the pair of cover members.

6. The fluid pressure cylinder according to claim 1, wherein the seal includes o-rings protruding radially, and the positioning members engage with the cylinder tube through the grooves and the o-rings.

7. The fluid pressure cylinder according to claim 6, wherein each of the o-rings is provided closer to the end of the cylinder tube than each of the grooves.

* * * * *